US006701899B2

(12) United States Patent
Liskow

(10) Patent No.: US 6,701,899 B2
(45) Date of Patent: Mar. 9, 2004

(54) FUEL INJECTION UNIT

(75) Inventor: Uwe Liskow, Pleidelsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/169,967

(22) PCT Filed: Nov. 12, 2001

(86) PCT No.: PCT/DE01/04206

§ 371 (c)(1),
(2), (4) Date: Nov. 6, 2002

(87) PCT Pub. No.: WO02/38943

PCT Pub. Date: May 16, 2002

(65) Prior Publication Data

US 2003/0145831 A1 Aug. 7, 2003

(30) Foreign Application Priority Data

Nov. 11, 2000 (DE) ..... 100 56 005

(51) Int. Cl.[7] ..... F02M 33/02
(52) U.S. Cl. ..... 123/470
(58) Field of Search ..... 123/456, 468, 123/469, 470, 472

(56) References Cited

U.S. PATENT DOCUMENTS 5,752,487 A * 5/1998 Harrell et al. ..... 123/470
6,102,007 A 8/2000 Fuerst
6,178,950 B1 * 1/2001 Stockner et al. ..... 123/470
6,199,538 B1 * 3/2001 Aota et al. ..... 123/470

FOREIGN PATENT DOCUMENTS

| | | |
|---|---|---|
| DE | 197 35 665 | 1/1999 |
| DE | 197 25 076 | 8/2000 |
| JP | 08-312503 | 11/1996 |

* cited by examiner

*Primary Examiner*—Thomas N. Moulis
(74) *Attorney, Agent, or Firm*—Kenyon & Kenyon

(57) ABSTRACT

A fuel injection system including at least one fuel injector having an inlet section and a fuel distributor line with a connecting piece for each fuel injector. For sealing a connection of each fuel injector to the respective connecting piece of the fuel distributor line, a ring-shaped seal support is provided for each, having an inner sleeve which is guided by a guide section of the inlet section, and having an outer sleeve which radially surrounds the inner sleeve and is elastically connected to the inner sleeve radially. The seal support together with the outer sleeve surrounds a sealing element. At the same time, the sealing element is peripherally in contact with an inside wall of the connecting piece and axially in contact with a radial end face of the inlet section of the fuel injector.

16 Claims, 1 Drawing Sheet

FUEL INJECTION UNIT

FIELD OF THE INVENTION

The present invention relates to a fuel injection system for injection of fuel into an internal combustion engine, in particular for direct injection of fuel into the combustion chamber(s) of the internal combustion engine.

BACKGROUND INFORMATION

A fuel injection system is described in German Published Patent Application No. 197 25 076. It has a ring-shaped seal support for a sealing connection between a fuel injector and a respective connecting piece of a fuel distributor line, this seal support cooperating with a first sealing element for sealing the seal support with respect to an end face of an inlet section of the fuel injector and cooperating with a second sealing element for sealing the seal support with respect to the connecting piece of the fuel distributor line. A bushing insertable into a fuel inlet orifice of the inlet section passes through the ring-shaped seal support, so that the seal support is movably secured in the radial direction between an upstream collar of the bushing and the inlet section of the fuel injector.

One feature of the arrangement described in the aforementioned publication is that due to the total of two sealing elements, there are two components which may be subject to defects and may result in leakage in particular. The two sealing elements are installed one above the other and therefore may require vertical space. Since the sealing elements may not lie in direct contact with one another and sufficient material may be required to be available to fill out the ring grooves, the additional vertical space required for the seal support may not be insignificant. Another feature of the arrangement described in the aforementioned publication is that radial mobility of the seal support may be ensured only if it has a certain axial play and is not pressed by the bushing against the inlet section. Consequently, during installation the bushing may be required to be inserted into the fuel inlet orifice to a precisely defined depth and the bushing as well as the fuel inlet orifice in the fuel injector may be required to be manufactured to a very high precision.

A fuel injector which has an inlet section and is insertable into a receiving bore and is sealed by an O-ring on this inlet section with respect to a connecting piece of a fuel distributor line is described in Japanese Published Patent Application No. 08-312503. The O-ring is in sealing contact with an inside wall of the connecting piece.

One feature of this fuel injector may be that the deviations which may occur in the fuel injector relative to the fuel distributor line due to manufacturing tolerances may be compensated only by asymmetrical pinching of the O-ring inasmuch as the axes of the connecting piece of the fuel distributor line and the fuel injector are shifted relative to one another. This may result in leakage even with relatively minor pinching of the O-ring.

SUMMARY OF THE INVENTION

A fuel injection system according to the present invention may provide that deviations in the axial position of the connecting piece of the fuel distributor line and the fuel injector relative to one another may be compensated reliably. This may prevent unwanted warping of the fuel injector relative to the fuel distributor line. This may yield in particular a smaller vertical space required in comparison with the conventional seals, which may allow tolerances to be compensated. In an example embodiment, the inner sleeve and the outer sleeve may be connected by spiral springs.

Pressure equalizing bores may be provided in the outer sleeve to connect the fuel chamber to a clearance volume formed between the sealing edges of the sealing arrangement and the outer sleeve. The sealing arrangement may thus be acted upon by the pressure of the fuel over a larger extent of its cross section and the contact pressure of the sealing edges may be increased.

The seal support may be secured by a locking ring on the guide section of the fuel injector with its inner sleeve against the end face of the inlet section. A gap may remain between the end face of the inlet section and the outer sleeve of the seal support due to the elasticity of the sealing element even when acted upon by fuel under pressure. Even when the inner sleeve is pressed by the locking ring against the end face due to the manufacturing tolerances, the outer ring having the sealing element may retain its functionality.

In an example embodiment, the guide section is formed by a hollow screw which may be screwed into a threaded bore of the fuel injector and may hold the seal support against the fuel injector.

The outer ring may have an upstream peripheral conical chamfer arranged on the outside radially. This may facilitate insertion of the seal support into the connecting piece.

DETAILED DESCRIPTION

Figure 1:
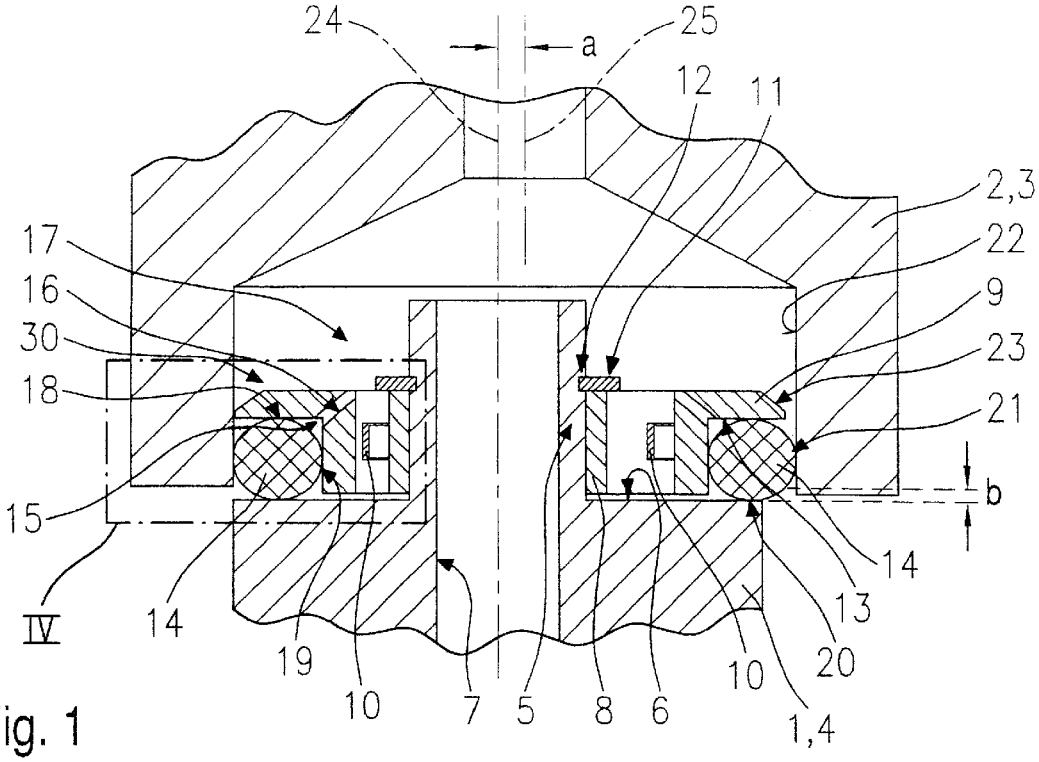
FIG. 1 shows a section through an example embodiment according to the present invention in a detail of an illustration of the connecting area between the fuel injector and the fuel distributor line.

FIG. 1 shows, as a sectional diagram of a portion of an example embodiment according to the present invention of a fuel injection system, the connecting area between a fuel injector 1 and a fuel distributor line 2. Fuel distributor line 2 is shown here only in the area of a connecting piece 3, and fuel injector 1 is shown here only in the area of an inlet section 4 having a guide section 5.

Inlet section 4 is formed in one piece with fuel injector 1. An end face 6 is formed at the transition of inlet section 4 to guide section 5. A fuel inlet bore 7 of fuel injector 1 passes through guide section 5 and inlet section 4. A seal support 30 is composed of an inner sleeve 8 and an outer sleeve 9 which surrounds inner sleeve 8 radially and is elastically connected to inner sleeve 8 via plate springs 10 arranged in a spiral. Guide section 5 passes through and guides inner sleeve 8. A locking ring 11 secures inner sleeve 8 in its position and presses it against end face 6 of inlet section 4.

Locking ring 11 is inserted into a peripheral groove 12 of guide section 5. An O-ring 14 is inserted as a sealing element into a rectangular step 13 which is formed on outer sleeve 9 and faces end face 6. A clearance volume 15 between outer sleeve 9 and O-ring 14 communicates with fuel chamber 17 to be sealed via a pressure equalizing bore 16. Clearance volume 15 is formed between sealing edges 18, 19 of O-ring 14 with respect to step 13 of outer sleeve 9. With an axial sealing edge 20, O-ring 14 rests on end face 6 and with a peripheral sealing edge 21 it rests on an inside wall 22 of connecting piece 3. Outer sleeve 9 has a peripheral conical chamfer 23 on its downstream end. A central axis 24 through fuel injector 1 is shown for the sake of illustration. Likewise, a central axis 25 through connecting piece 3 is also shown. Axes 24, 25 may also have an offset by distance a due to manufacturing tolerances.

Outer sleeve 9 is connected to inner sleeve 8 only elastically by plate springs 10, so that only minor forces are transmitted in the axial direction. Regardless of whether and with what force inner sleeve 8 is pressed against end face 6, a gap b is formed between outer sleeve 9 and end face. 6, the size of this gap depending on the elasticity of O-ring 14 and the prevailing pressure in fuel chamber 17. Therefore, outer sleeve 9 may be easily displaceable radially. In conjunction with chamfer 23, outer sleeve 9 is adjusted to offset a in assembly. This may be possible as long as axial sealing edge 20 is still resting completely on end face 6. In operation of fuel injector 1, the sealing effect of O-ring 14 is reinforced by pressure equalizing bore 16. Due to pressure equalizing bore 16, O-ring 14 is also acted upon by fuel under pressure in clearance volume 15 on its cross-sectional extent between sealing edges 18, 19 against outer sleeve 9. Therefore, the contact pressure on axial sealing edge 20 and peripheral sealing edge 21 is reinforced.

Figure 2:
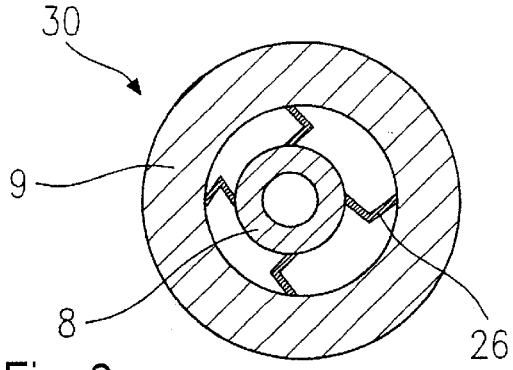
FIG. 2 shows a top view of a seal support of the example embodiment illustrated in FIG. 1.

FIG. 2 shows a top view of seal support 30 from FIG. 1 having a configuration of plate springs 26 according to an example embodiment of the present invention. Outer sleeve 9 concentrically surrounds inner sleeve 8. The two are connected elastically via plate springs 26, which are directed radially outward and have a fold in the example embodiment illustrated here.

Figure 3:
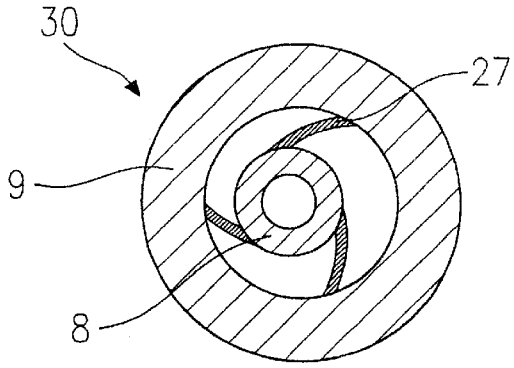
FIG. 3 shows a top view of an alternative example embodiment of a seal support.

FIG. 3 shows a view of seal support 30 from FIG. 1, illustrating another configuration of plate springs 27 according to an example embodiment of the present invention. Outer sleeve 9 concentrically surrounds inner sleeve 8. The two are connected by plate springs 27, which are configured as spiral plate springs directed radially outward.

Figure 4:
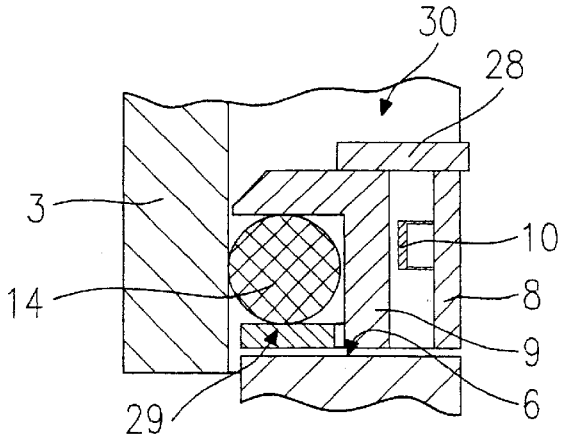
FIG. 4 shows another example embodiment of a fuel injection system according to the present invention in a detail corresponding to detail IV in FIG. 1.

FIG. 4 shows another example embodiment of a fuel injection system according to the present invention in a detail corresponding to detail IV in FIG. 1. Since this example embodiment differs from the example embodiment illustrated in FIG. 1 only in this detail, the same reference numbers have been used for the same parts. Seal support 30 is composed of inner sleeve 8 and outer sleeve 9, which surrounds inner sleeve 8 radially and is elastically connected to inner sleeve 8 via plate springs 10 arranged in a spiral. A locking ring 28 sitting in groove 12 holds inner sleeve 8 and outer sleeve 9 against end face 6. O-ring 14 arranged in step 13 of outer sleeve 9 is supported by a supporting ring 29 arranged between O-ring 14 and end face 6. O-ring 14 is in sealing contact with connecting piece 3.

In the example embodiment of fuel injection system illustrated here, outer sleeve 9 is held more securely in its position. O-ring 14 may be deformed to a greater extent by supporting ring 29 without resulting in any leakage.

What is claimed is:

1. A fuel injection system for injecting fuel into an internal combustion engine, comprising:

at least one fuel injector including an inlet section having a guide section and a radial end face;

a fuel distributor line including a connecting piece, the connecting piece having an inside wall and being connectable to the inlet section;

a sealing element; and a ring-shaped seal support for sealingly connecting the at least one fuel injector to the connecting piece, the ring-shaped seal support including an inner sleeve and an outer sleeve, the inner sleeve being guided by the guide section, the outer sleeve being arranged to surround the inner sleeve radially and being elastically connected to the inner sleeve radially, the ring-shaped seal support, together with the outer sleeve, being arranged to surround the sealing element and, at the same time, to hold the sealing element peripherally against the inside wall and axially against the radial end face.

2. The fuel injection system according to claim 1, wherein the outer sleeve includes a step facing the fuel injector for guiding the sealing element.

3. The fuel injection system according to claim 1, further comprising:

a plurality of springs for elastically connecting the inner sleeve and the outer sleeve.

4. The fuel injection system according to claim 3, wherein the springs include plate springs arranged in a spiral between the inner sleeve and the outer sleeve.

5. The fuel injection system according to claim 4, wherein the plate springs are folded.

6. The fuel injection system according claim 1, further comprising:

a fuel chamber arranged to be sealed;

wherein the outer sleeve includes at least one pressure equalizing bore for connecting the fuel chamber to a clearance volume formed between sealing edges of the sealing element and the outer sleeve.

7. The fuel injection system according to claim 1, wherein the guide section includes a locking ring for securing the inner sleeve to the radial end face.

8. The fuel injection system according to claim 7, wherein the locking ring is arranged to cover the outer sleeve at least partially.

9. The fuel injection system according to claim 8, further comprising:

a fuel chamber arranged to be sealed, wherein:

the outer sleeve includes pressure equalizing bores for connecting to a clearance volume formed between sealing edges of the sealing element and the outer sleeve, and the locking ring includes one of other pressure equalizing bores and grooves through which the fuel chamber is connected to the pressure equalizing bores.

10. The fuel injection system according to claim 7, wherein the locking ring is welded to the guide section.

11. The fuel injection system according to claim 7, wherein the guide section includes a groove to hold the locking ring.

12. The fuel injection system according to claim 7, further comprising:

a hollow screw for engaging a fuel inlet bore configured as a threaded bore and for holding the locking ring on the guide section.

13. The fuel injection system according to claim 7, wherein:

a gap is arranged to remain between the radial end face and the outer sleeve due to an elasticity of the sealing element, even when acted upon by fuel under pressure.

14. The fuel injection system according to claim 1, wherein the sealing element is configured as a peripheral ring seal.

15. The fuel injection system according to claim 1, wherein the outer sleeve includes a peripheral conical chamfer arranged on the outside, radially at an upstream end thereof.

16. The fuel injection system according to claim 1, further comprising:

a supporting ring arranged between the sealing element and the radial end face.

* * * * *